US008381952B2

(12) United States Patent
Mainetti

(10) Patent No.: US 8,381,952 B2
(45) Date of Patent: Feb. 26, 2013

(54) CLOTHES HANGER WITH FOLD-AWAY HOOK

(75) Inventor: Mario Mainetti, Valdagno (IT)

(73) Assignee: Mainetti S.p.A., Castelgomberto (Vicenza) (IT)

( * ) Notice: Subject to any disclaimer, the term of this patent is extended or adjusted under 35 U.S.C. 154(b) by 0 days.

(21) Appl. No.: 13/223,449

(22) Filed: Sep. 1, 2011

(65) Prior Publication Data

US 2012/0104056 A1 May 3, 2012

(30) Foreign Application Priority Data

Nov. 3, 2010 (IT) ..... VI2010A0293

(51) Int. Cl.
*A41D 27/22* (2006.01)

(52) U.S. Cl. ..... 223/85; 223/92; 223/DIG. 4

(58) Field of Classification Search ..... 223/85, 223/87, 92, 95, DIG. 4; 40/322
See application file for complete search history.

(56) References Cited

U.S. PATENT DOCUMENTS

| | | | | | |
|---|---|---|---|---|---|
| 2,428,820 | A | | 10/1947 | Therrien | |
| 3,726,452 | A | | 4/1973 | Jaffe | |
| 3,870,206 | A | * | 3/1975 | Feinberg | 223/88 |
| 4,063,670 | A | | 12/1977 | Faarbech | |
| 4,168,791 | A | * | 9/1979 | Clark, Jr. | 223/94 |
| 4,487,343 | A | | 12/1984 | Chen | |
| 4,932,571 | A | * | 6/1990 | Blanchard | 223/89 |
| 5,183,190 | A | * | 2/1993 | Zuckerman | 223/96 |
| 5,383,584 | A | * | 1/1995 | Adams | 223/94 |
| 5,785,216 | A | * | 7/1998 | Gouldson et al. | 223/85 |
| 6,000,587 | A | * | 12/1999 | Sackett et al. | 223/85 |
| D462,439 | S | | 9/2002 | Montgomery et al. | |
| 7,380,359 | B2 | | 6/2008 | Mainetti | |
| 2009/0283556 | A1 | * | 11/2009 | Ho | 223/85 |

FOREIGN PATENT DOCUMENTS

| | | | |
|---|---|---|---|
| GB | 269465 | | 4/1927 |
| GB | 344731 | | 3/1931 |
| GB | 2 355 922 | | 5/2001 |
| JP | 08168433 | A * | 7/1996 |
| JP | 2002172055 | A * | 6/2002 |
| WO | 99/60899 | | 12/1999 |

OTHER PUBLICATIONS

Italian Search Report and Written Opinion dated Jun. 8, 2011, from corresponding Italian Application No. ITVI20100293.

* cited by examiner

*Primary Examiner* — Nathan Durham
(74) *Attorney, Agent, or Firm* — Katten Muchin Rosenman LLP

(57) ABSTRACT

The finding concerns a clothes hanger with fold-away hook. Therein, in that the base of the hook, on one side is connected to the arched body through a flexible tongue, which allows the aforementioned hook to elastically twist, in particular to rotate by 90° and more, from vertical to horizontal and vice versa, or else from perpendicular to parallel on the arched body, whereas on the opposite side said base is equipped with a fastening system that, in the operative step, holds the hook on the body, so that, when the hook is lifted, the clothes hanger takes up the typical configuration, the normal function and has the same strength as a common clothes hanger with fixed hook.

13 Claims, 6 Drawing Sheets

CLOTHES HANGER WITH FOLD-AWAY HOOK

BACKGROUND OF THE INVENTION

1. Field of the Invention

The present finding concerns a clothes hanger with a fold-away hook.

2. Background

A common clothes hanger is made up of an arched body, equipped at the centre with a projecting hook. The hook is made up of a steel filiform body which is fixedly interlocked, with its lower part, into the arched body, made from plastic, or it is made up of a shaped band, which is made from the same material as the body.

Normally, clothes hangers are reused many times, therefore, after the hung clothing has been removed, they are stored away while waiting to be used again.

The drawback during such an operative step consists of the considerable bulk required for storing clothes hangers, since each clothes hanger, when packed or put away, takes up a two-dimensional space that is defined, on one side, by the width of the arched body and, on the other side, by the height of the arched body summed to the projection of the hook.

In practical use, the bulk of the clothes hanger constitutes an important parameter to be evaluated: both in clothes hanger manufacturing centers, in which it is required for there to be the maximum reduction of the sizes of the packages used for sending the clothes hangers themselves to the garment maker, and, in particular, when the clothes hanger is used for sending clothing items directly to the end users, as is becoming increasingly more common through mail-order sales channels, in which the bulk of the clothes hangers affects the dimensions, and consequently the cost of the packaging and of the relative delivery costs.

At the current state of the art clothes hangers are known, the bulk of which can become smaller when they are not being used, as an example, those described in U.S. Pat. Nos. 3,726,452, 4,487,343, 2,428,820, 4,063,670, 462,439 and GB 2,355,922, in which the hook is held on the arched body by means of mobile connections which allow it, if needed, to be disengaged and to slide inside the space defined by the arched body itself.

Disadvantageously, in the aforementioned documents, making these clothes hangers requires a very complex manufacturing technique, since the manufacturing solutions for allowing the hook to rotate foresee the use of two separate pieces, which means that, in order to make the hook mobile between the two elements, it is necessary to strongly modify the configuration both of the arched body, and of the lower end of the hook, with considerable costs in terms of molding, of assembly and of production in general.

Moreover, in the manufacturing solutions known to this day, due to the mobility of the connection between hook and arched body, the clothes hanger, when it is being used, is not rigid, like in common clothes hangers, in which the arched body and the hook form a single rigid body, which, in practical use, means that it is difficult for the hung clothing to be held in an optimal manner, to the point of actually falling off.

The purpose of the present finding is that of foreseeing a clothes hanger that, when it is not being used, is capable of taking up a configuration with small bulk and the manufacture of which, is substantially simplified with respect to used manufacturing techniques for manufacturing similar known types of clothes hangers.

Specifically, the purpose of the present finding is to make a clothes hanger provided with a hook that is made in a single structure with the body of the clothes hanger itself and in which said hook can be released from the seat of origin through a simple and rapid manual maneuver.

Again specifically, the purpose of the present finding is to make a clothes hanger with a fold-away hook, which does not substantially move away from the configuration of a normal clothes hanger with a fixed hook, so that the usual molding equipment, subject to small modifications, can be used, to the benefit of the low cost of the end product.

Again specifically, one purpose of the present finding is to make a clothes hanger with a fold-away hook which when being used, i.e. with its hook extended, forms a rigid structure that can hold the hung clothing item tightly.

Again specifically, the purpose of the present finding is to make a clothes hanger with a fold-away hook in which the movement of the hook requires a simple and rapid manual operation.

SUMMARY OF THE INVENTION

Such purposes are achieved by making a clothes hanger, which is characterised in that the base of the hook, on one side, is connected to the arched body, through a flexible tongue which allows the aforementioned hook to elastically twist, in particular to rotate by 90° and more, from vertical to horizontal and vice versa, or else from perpendicular to parallel on the arched body whereas on the opposite side it is equipped with a fastening system that holds the hook on the aforementioned body in the operative step, i.e. when the hook is lifted the clothes hanger takes up the typical configuration, the normal function and has the same strength as a common clothes hanger with fixed hook.

BRIEF DESCRIPTION OF THE DRAWINGS

The finding shall become clearer from the description of three possible embodiments, given as a non-limiting example, with the help of the attached drawing tables, in which.

DETAILED DESCRIPTION OF THE INVENTION

Figure 1:
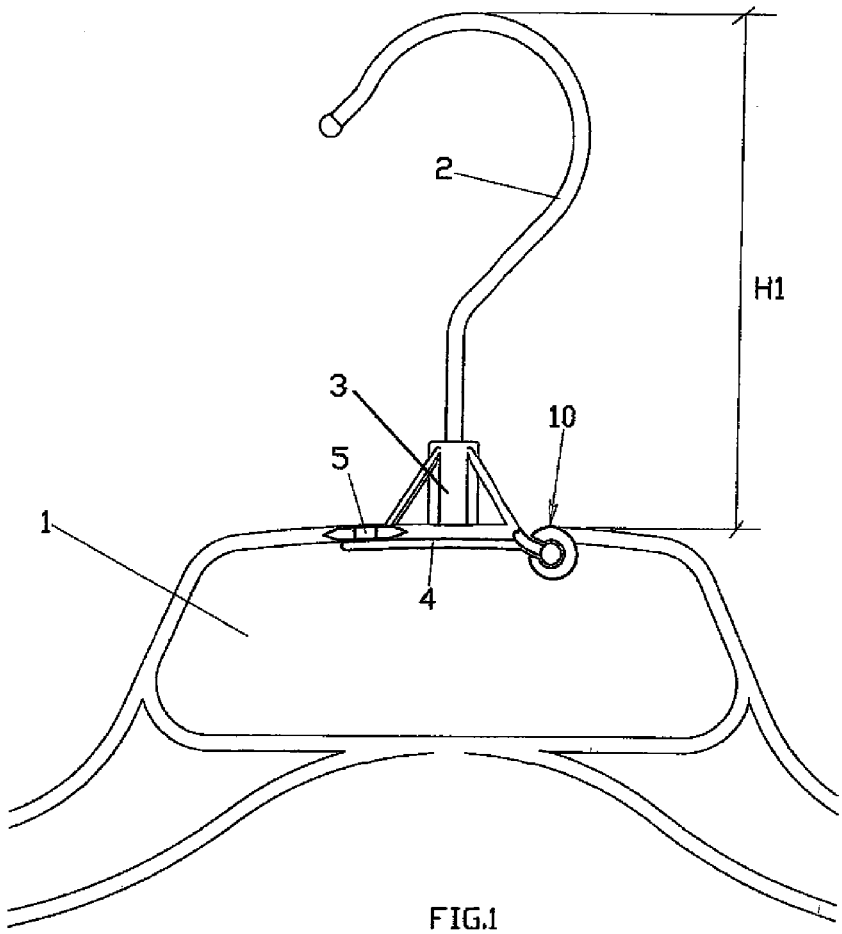
FIGS. 1-4 (tables I-II) represent front and perspective views of a first embodiment of the clothes hanger according to the finding, in the conditions with the hook active and with the hook folded away.

The clothes hanger according to the finding of the type made up of an arched body 1, equipped with a steel hook 2, which has the lower end slotted into a base with a pawl 3, or of the type in which the hook 2 constitutes the extension of said body, so as to allow the size label to be applied on the side (see U.S. Pat. No. 7,380,359) all in a per se known way; according to the finding said base 3 is spaced apart and is independent, by making a slit 4, from the underlying body 1 and it is held on the aforementioned body through a flexible tongue 5, arranged on one side of the base and coming out from said body; on the other side it is equipped with a fastening system, wholly indicated with reference numerals 10 and 20, which holds and locks the aforementioned hook in the upright position.

Figure 2:
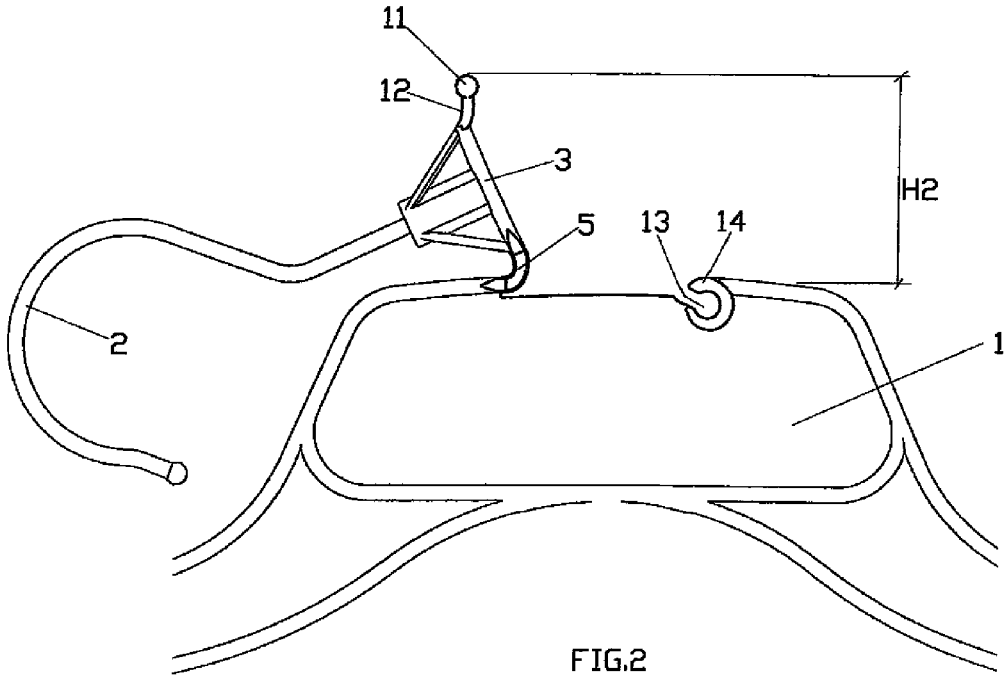

As visible in FIGS. 1-2, the fastening system 10 with horizontal axis, i.e. perpendicular to the plane in which there is the body-hook, is of the interlocking type, in which a pin 11, fixedly connected to the base 3 through the bridge 12, slots into a seat 12, defined by an open ring 14, formed on the body 1.

Figure 9:
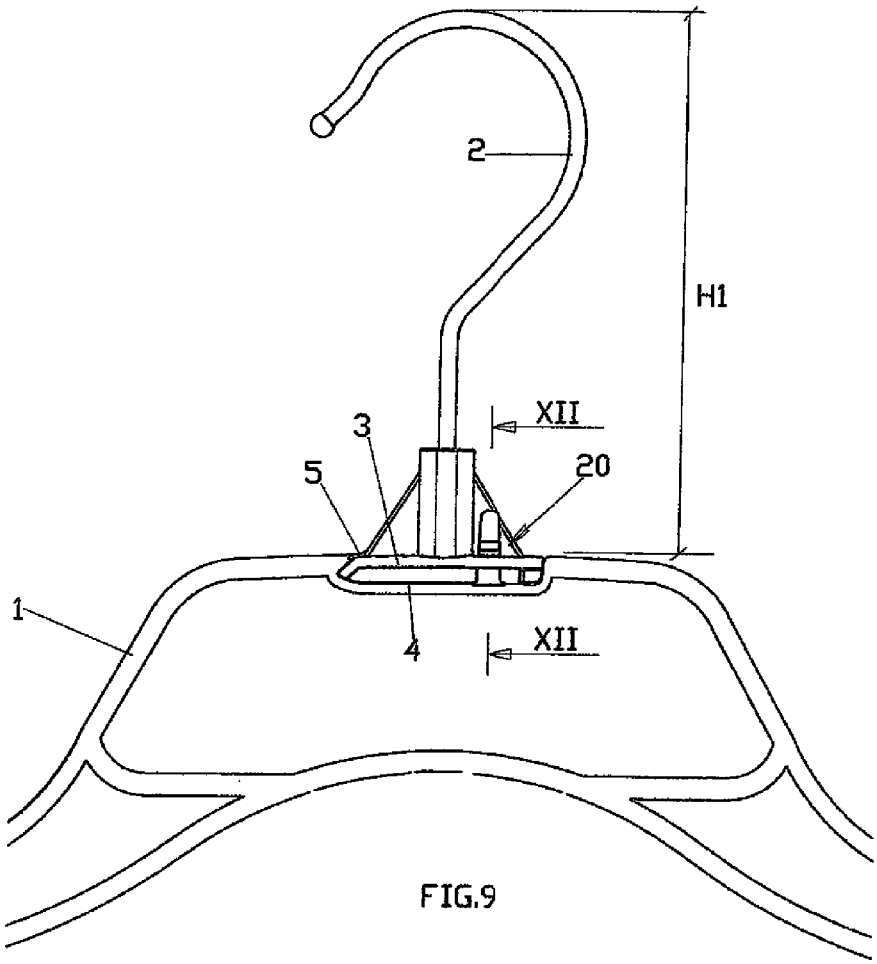
FIGS. 9-11 (tables V-VI) represent front and perspective views of a third embodiment of the clothes hanger according to the finding, in the conditions with the hook active and with the hook folded away.
Figure 10:
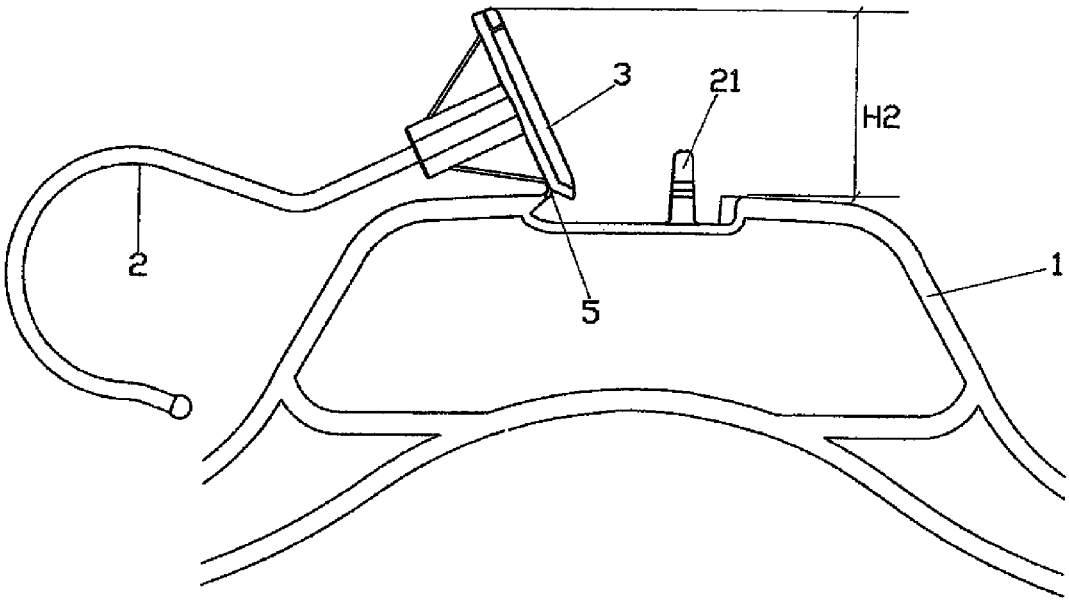
Figure 11:
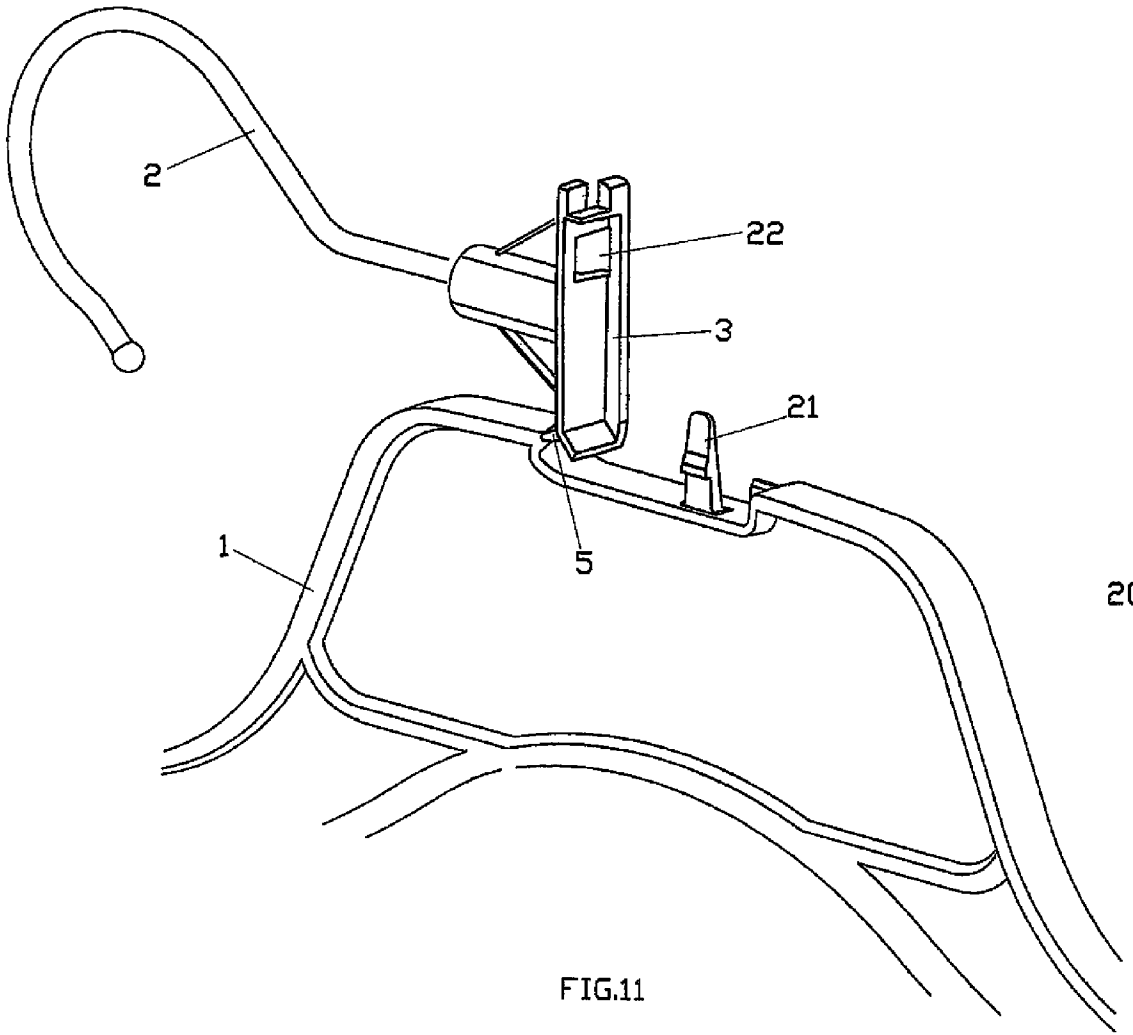

In a further embodiment, as visible in FIGS. 9-11, the base 3 of the hook 2, spaced from the body 1 through the slit 4, is held on the aforementioned body through a flexible tongue 5, arranged on one side of the base and projecting out from said body, whereas on the opposite side there is a fastening system 20, which holds and locks the hook 2 in an upright position.

Figure 12:
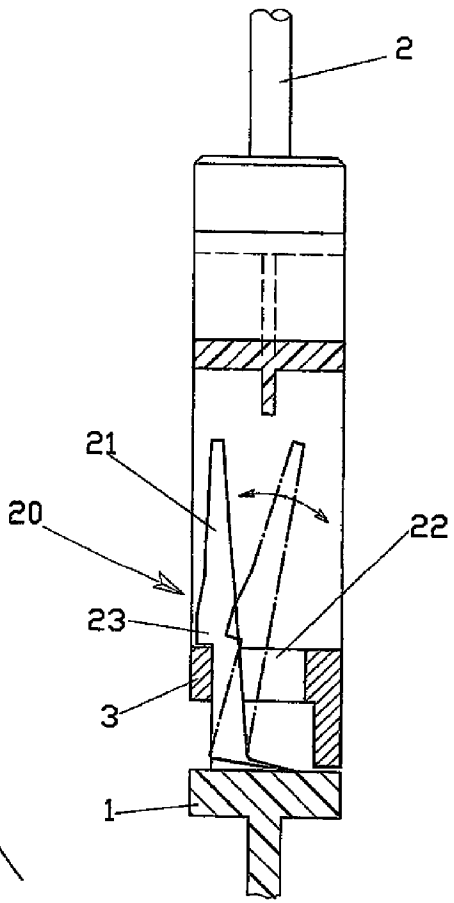
FIG. 12 represents a detailed view of the hook, in section along the line XII-XII of FIG. 9.

As visible in FIGS. 9 and 12, the fastening system 20, with vertical axis, i.e., contained in the plane in which the body-hook lies, is of the so called "clip" type, in which a flexible tooth 21, projecting from the body 1, slots into a slit 22 made on the base 3 with an elastic deformation so that when the hook 2 is in its active position, the undercut portion constitutes the abutment step 23 that holds the aforementioned base.

Figure 3:
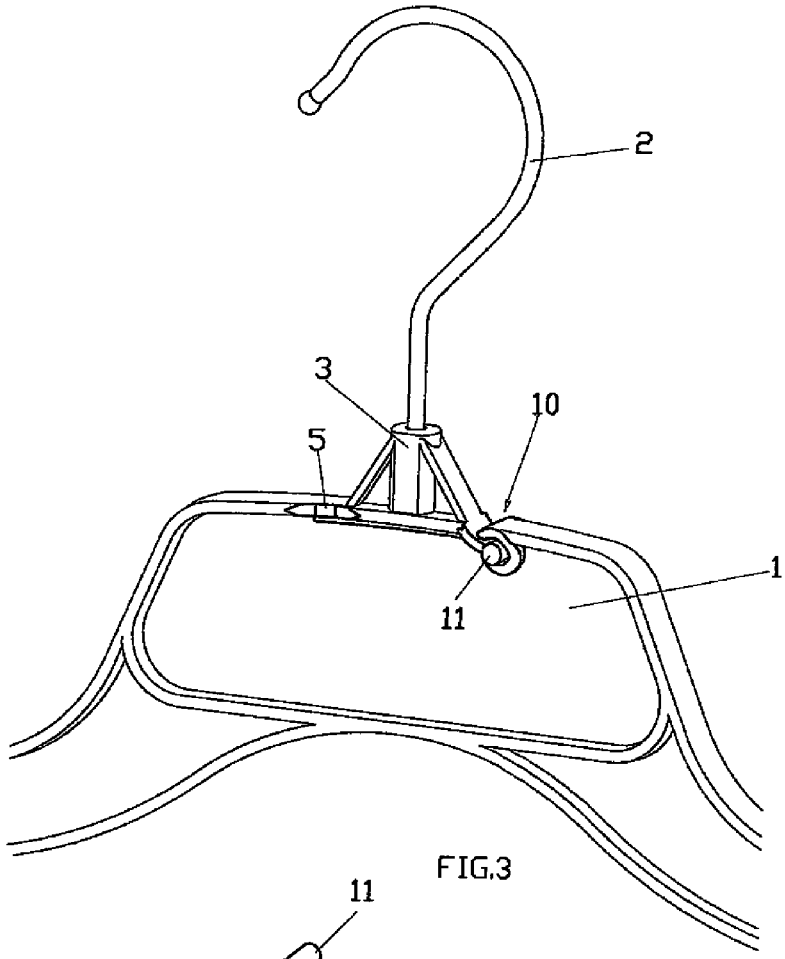
Figure 4:
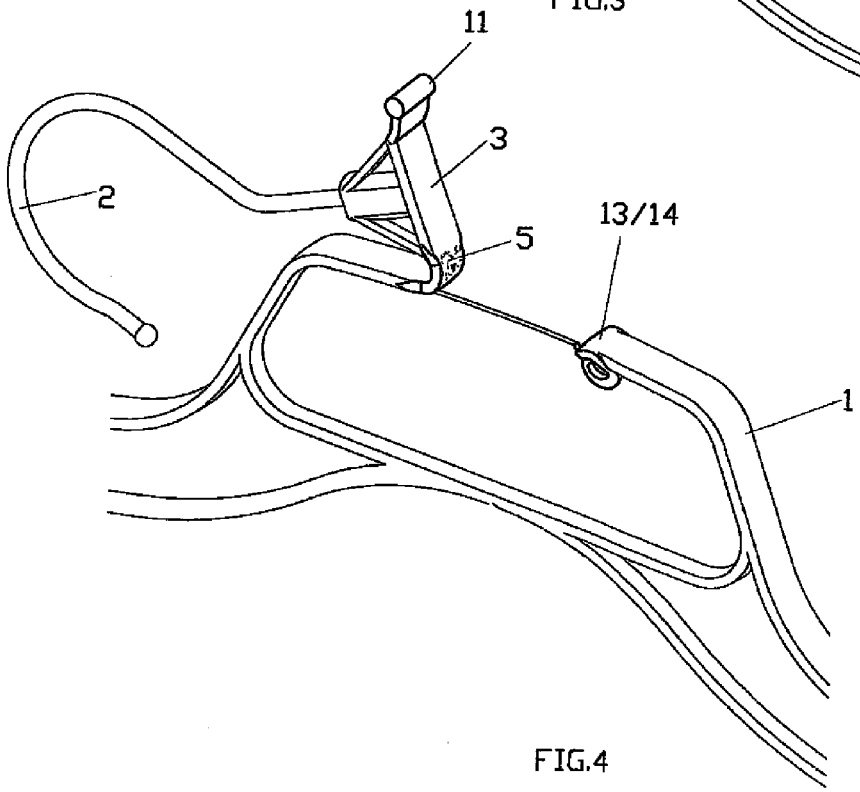
Figure 5:
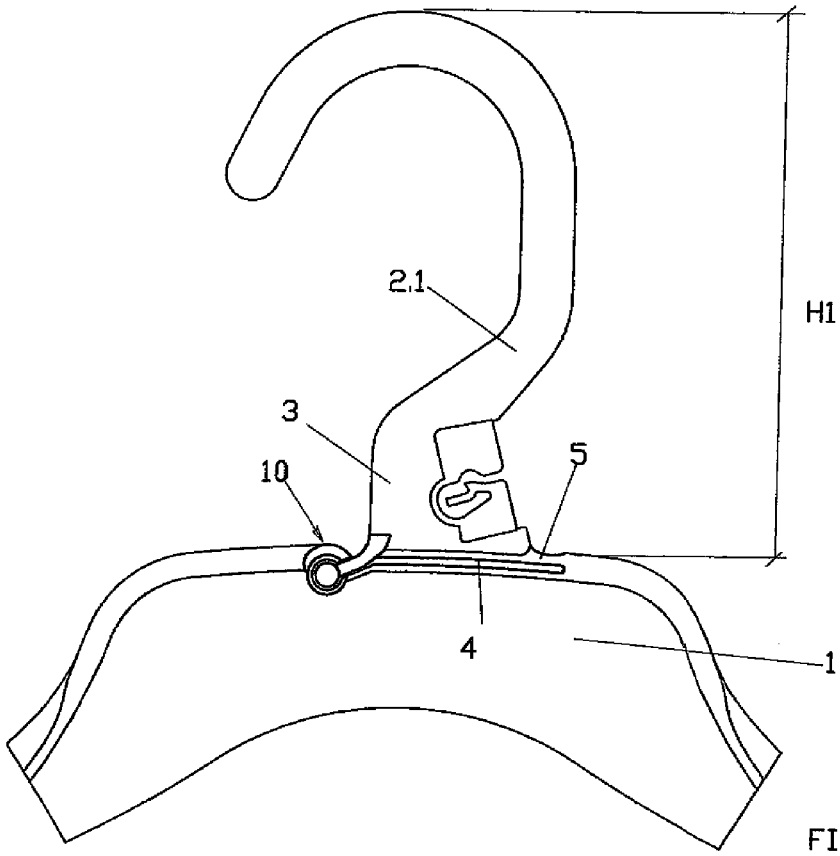
FIGS. 5-8 (tables III-IV) represent front and perspective views of a second embodiment of the clothes hanger according to the finding, in the conditions with the hook active and with the hook folded away.
Figure 6:
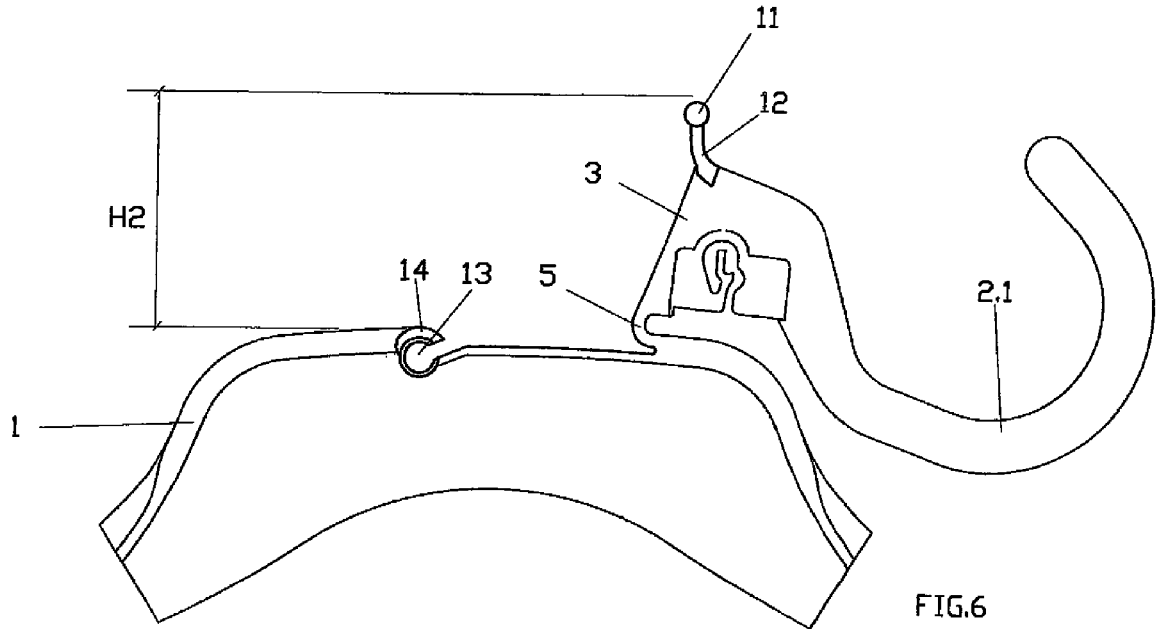
Figure 7:
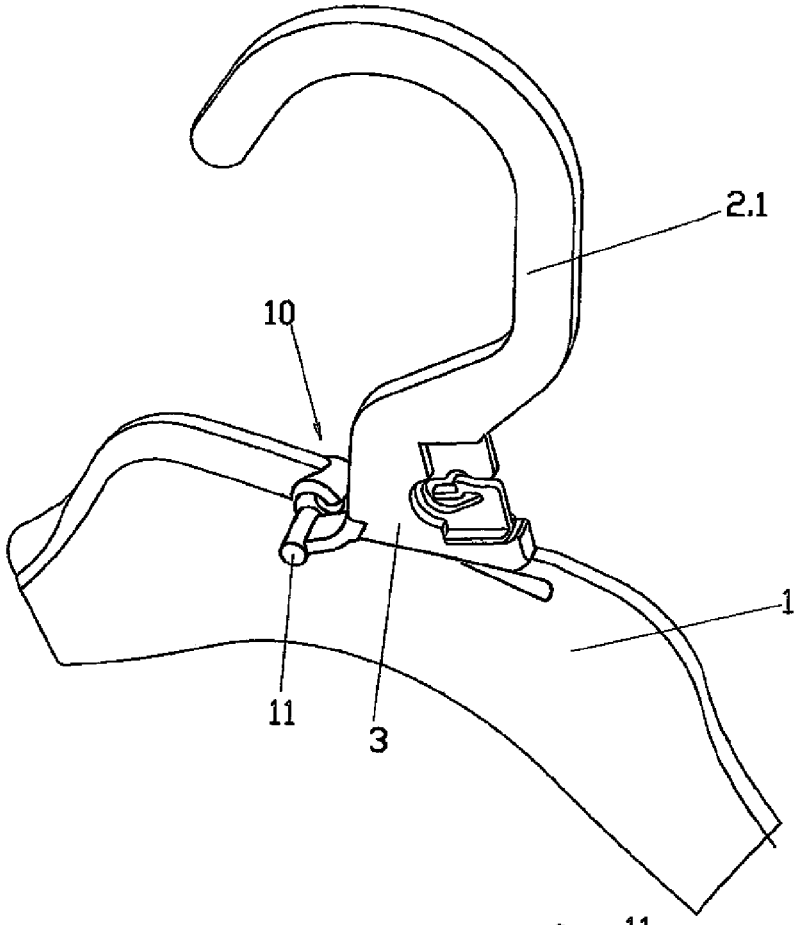
Figure 8:
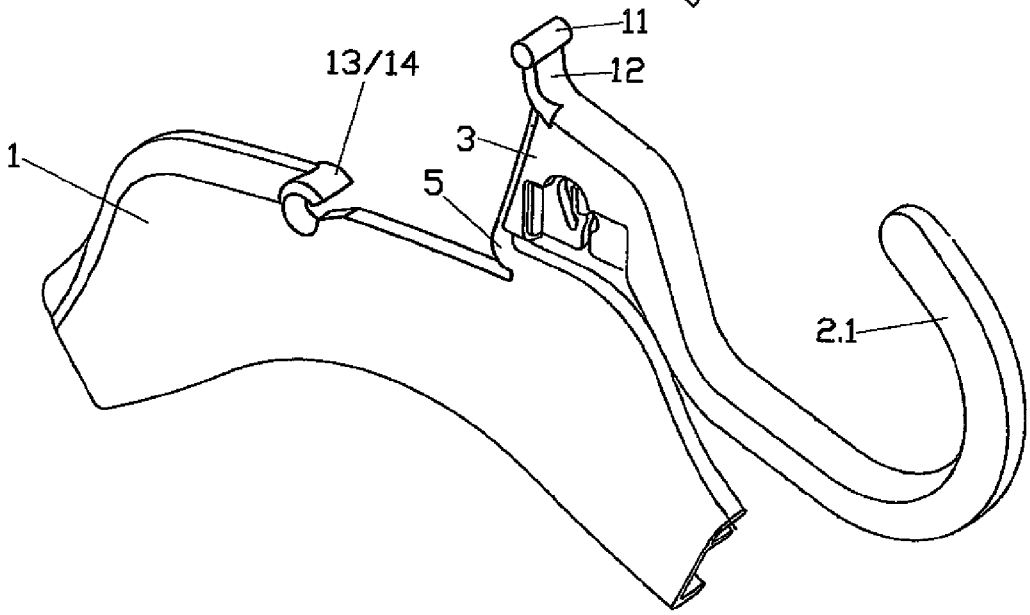

In practical use, after the release operation, which with the fastening system 10 occurs through a minimum lateral rotation of the base 3, so as to free the pin 11 from the seat 13 (see FIG. 3), whereas in the fastening system 20 it occurs by pushing the flexible tooth 21 by the amount necessary to free the step 23 (see FIG. 12), the hook 2 can undergo rotations of 90° and more, so that the bulk of the hook is reduced from the maximum height "H1" to the minimum height "H2".

The finding thus conceived can undergo variants and modifications and its details, for example the type of fastening systems, can be replaced by technically equivalent elements, all of this as long as it is covered by the inventive concept defined by the following claims.

What is claimed is:

1. A clothes hanger comprising:

an arched body;

a fold-away hook comprising a base and a flexible tongue, the base comprising a first and second side, the flexible tongue being disposed on the first side of the base; and a fastening system being disposed at least partially on the second side of the base and partially on the arched body;

wherein the hook is movable between a first state where the hook is stored to a second state where the hook operatively supports the body and clothes disposed on the body with a typical function and strength;

wherein the flexible tongue permits the hook to elastically twist from a substantially horizontal position to a vertical position when moving from the first state to the second state and from the vertical position to the substantially horizontal position when moving from the second state to the first state; and wherein the fastening system operatively locks the hook on the body in the second state wherein the fastening system further comprises a receiving portion disposed in the body;

wherein the fastening system comprises an end element having an axis perpendicular to a main axis of the body, wherein the end element interlocks with the receiving portion;

wherein the end element comprises a pin fixedly connected to the base through a bridge; and wherein the receiving portion comprises a seat defined by an open ring formed in the body.

2. The clothes hanger of claim 1, wherein the fold-away hook comprises a hooked steel portion, the steel portion having a lower end slotted into the base having a pawl, wherein the body comprises a slit to space the base of the fold-away hook from the body.

3. The clothes hanger of claim 1, wherein the fold-away hook comprises an extension of said body to allow a lateral application of a size label, wherein the body comprises a slit to space the base of the fold-away hook from the body.

4. The clothes hanger of claim 1, wherein the arched body, the base of the hook, the flexible tongue, and the fastening system are a mono-structure made with identical material and via a single molding operation.

5. The clothes hanger of claim 1, wherein the flexible tongue and the base comprise a mono-structure.

6. The clothes hanger claim 1, further comprises a major plane which comprises a longitudinal centerline of the hanger, the hook elastically twisting in the major plane.

7. The clothes hanger of claim 1, wherein the hook further elastically twists in a plane non-parallel to the major plane.

8. A clothes hanger comprising:

a body;

a fold-away hook comprising a base and a flexible tongue, the base comprising a terminal side end and a base portion located distal from the terminal side end, the flexible tongue being disposed on the terminal side of the base; and a fastening system being disposed on the base portion and partially on the arched body;

wherein the hook is movable between a first state where the hook is stored to a second state where the hook operatively supports the body and clothes disposed on the body with a typical function and strength;

wherein the flexible tongue permits the hook to elastically twist from a substantially horizontal position to a vertical position when moving from the first state to the second state and from the vertical position to the substantially horizontal position when moving from the second state to the first state; and wherein the fastening system operatively locks the hook on the body in the second state;

wherein the fastening system comprises an interlock having an axis in a plane of a main axis of the body;

wherein the fastening system comprises a flexible tooth projecting from the body and a slit disposed in the base of the fold-away hook; and wherein when the hook is in the second state, the tooth slots into the slit to hold the lock the hook to the body.

9. The clothes hanger of claim 8, wherein the tooth comprises an abutment step to aid in locking the fold-away hook to the body.

10. The clothes hanger of claim 9, wherein the tooth is released by pushing the flexible tooth by an amount necessary to free the step.

11. The clothes hanger of claim 8, wherein the body, the base of the hook, the flexible tongue, and the fastening system are a mono-structure made with identical material and via a single molding operation.

12. The clothes hanger of claim 8, further comprises a major plane which comprises a longitudinal centerline of the hanger, the hook elastically twisting in the major plane.

13. The clothes hanger of claim 12, wherein the hook further elastically twists in a plane non-parallel to the major plane.

* * * * *